US008899354B1

(12) United States Patent
Comeau et al.

(10) Patent No.: US 8,899,354 B1
(45) **Date of Patent: *Dec. 2, 2014**

(54) DRILL BIT WITH A FLOW INTERRUPTER

(71) Applicant: Northbasin Energy Services Inc., Edmonton (CA)

(72) Inventors: Laurier E. Comeau, Leduc (CA); Geir Hareland, Calgary (CA); Jeff Janzen, Leduc (CA); John Kaminski, Leduc (CA)

(73) Assignee: Northbasin Energy Services Inc., Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/015,917

(22) Filed: Aug. 30, 2013

Related U.S. Application Data

(63) Continuation of application No. 12/638,175, filed on Dec. 15, 2009, now Pat. No. 8,544,567.

(51) Int. Cl.
*E21B 10/38* (2006.01)
*E21B 10/60* (2006.01)
*B05B 1/34* (2006.01)

(52) U.S. Cl.
CPC ..... *E21B 10/602* (2013.01)
USPC ..... 175/340; 175/297; 239/487

(58) Field of Classification Search
USPC ..... 175/393, 339, 340, 215, 297; 239/487, 239/489
See application file for complete search history.

(56) References Cited

U.S. PATENT DOCUMENTS

| | | | | |
|---|---|---|---|---|
| 2,735,653 | A * | 2/1956 | Bielstein | 91/40 |
| 5,337,838 | A * | 8/1994 | Sorensen | 175/59 |
| 7,617,886 | B2 * | 11/2009 | Hall | 175/51 |
| 2001/0054515 | A1 * | 12/2001 | Eddison et al. | 175/56 |

* cited by examiner

*Primary Examiner* — Giovanna Wright
*Assistant Examiner* — Wei Wang
(74) *Attorney, Agent, or Firm* — Perkins Coie LLP

(57) ABSTRACT

A drill bit is disclosed, comprising: a drill bit head having a cutting face with one or more fixed cutting elements; a flow passage extending through the drill bit head to the cutting face; a flow interrupter within the drill bit head and positioned to interrupt flow of fluid through the flow passage; and a power section connected to drive the flow interrupter and cause, in operation, variable flow of fluid through the flow passage. A method of drilling is also disclosed comprising: flowing fluid through a flow passage extending through a drill bit head to a cutting face of the drill bit head, the cutting face having one or more fixed cutting elements; and driving a flow interrupter within the drill bit head with a power section to interrupt the flow of fluid through the flow passage and cause variable flow of fluid through the flow passage.

19 Claims, 6 Drawing Sheets

DRILL BIT WITH A FLOW INTERRUPTER

TECHNICAL FIELD

This document relates to drill bits, and more specifically to drill bits with a flow interrupter for a flow passage within the drill bit.

BACKGROUND

Drill bits used to drill wellbores through earth formations generally fall within one of two broad categories of bit structures. Drill bits in the first category are known as roller, or roller-cone, drill bits. Drill bits of this type usually include a bit body having at least one roller cone. Typically, roller cone drill bits are constructed as tri-cone bits, but di- and mono-cone drill bits are available. As the roller cone bit is rotated in contact with the formation, cutter elements mounted about the periphery of each roller cone roll over the bottom hole formation, scraping, crushing, and pulverizing the formation into small pieces that are carried to the surface with the returning annular fluid.

Drill bits of the second category are commonly known as fixed cutter or drag bits. Bits of this type usually include a bit body upon which a plurality of fixed cutting elements is disposed. Most commonly, the cutting elements disposed about the drag bit are manufactured of cylindrical or disk-shaped materials known as polycrystalline diamond compacts (PDCs). PDC cutters drill through the earth by scraping/shearing away the formation rather than pulverizing/crushing it. Fixed cutter and drag bits are often referred to as PDC or natural diamond (NDB) and impregnated bits. Like their roller-cone counterparts, PDC and in some cases NDB and impregnated bits also include an internal plenum through which fluid in the bore of the drill string is allowed to communicate with a plurality of fluid nozzles.

Drill bits of both types may have flow passages terminating in jet nozzles out of which fluids flow to clear drill cuttings from the bottom of the bore being drilled.

SUMMARY

A drill bit is disclosed, comprising: a drill bit head having a cutting face with one or more fixed cutting elements; a flow passage extending through the drill bit head to the cutting face; a flow interrupter within the drill bit head and positioned to interrupt flow of fluid through the flow passage; and a power section connected to drive the flow interrupter and cause, in operation, variable flow of fluid through the flow passage.

A method of drilling is also disclosed comprising: flowing fluid through a flow passage extending through a drill bit head to a cutting face of the drill bit head, the cutting face having one or more fixed cutting elements; and driving a flow interrupter within the drill bit head with a power section to interrupt the flow of fluid through the flow passage and cause variable flow of fluid through the flow passage.

Another drill bit is disclosed, comprising: a drill bit head having a cutting face; a flow passage extending through the drill bit head to a downhole facing nozzle; a disk mounted for rotation within the drill bit head, the disk having one or more openings through the disk; and a power section connected to rotate the disk and cause, in operation, variable flow of fluid through the one or more openings to a channel, between the disk and the downhole facing nozzle, of the flow passage.

Another drill bit is disclosed, comprising: a drill bit head having a cutting face; a flow passage extending through the drill bit head to a downhole facing nozzle; a flow interrupter within the drill bit head and positioned to interrupt flow of fluid through the flow passage; and a progressive cavity pump connected to drive the flow interrupter and cause, in operation, variable flow of fluid through the flow passage.

Another drill bit is disclosed, comprising: a drill bit head having a cutting face; a flow passage extending through the drill bit head to a downhole facing nozzle; a flow interrupter within the drill bit head and positioned to interrupt flow of fluid through the flow passage; and a power section connected to drive the flow interrupter and cause, in operation, variable flow of fluid through the flow passage; in which the flow passage comprises a flow interrupter bypass that allows fluid to bypass the flow interrupter.

A method of drilling is also disclosed comprising: varying the flow interruptions by varying the flow interrupter system configuration to control the nozzle activation impulsion frequency exerted on the rock from the individual nozzle.

A method of drilling is also disclosed comprising: using a system where the design is such that the power section and flow diverter system is an integrated part of the actual drill bit or a separate unit that is connected to an actual drill bit head being either a roller cone bit head or a drag bit.

An insert for a drill bit, the drill bit having a drill bit head with a cutting face and a flow passage extending through the drill bit head to a downhole facing nozzle, the insert adapted to be inserted into the drill bit head, the insert comprising: a flow interrupter within the insert and positioned, in operation, to interrupt flow of fluid through the flow passage; and a power section within the insert connected to drive the flow interrupter and cause, in operation, variable flow of fluid through the flow passage.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
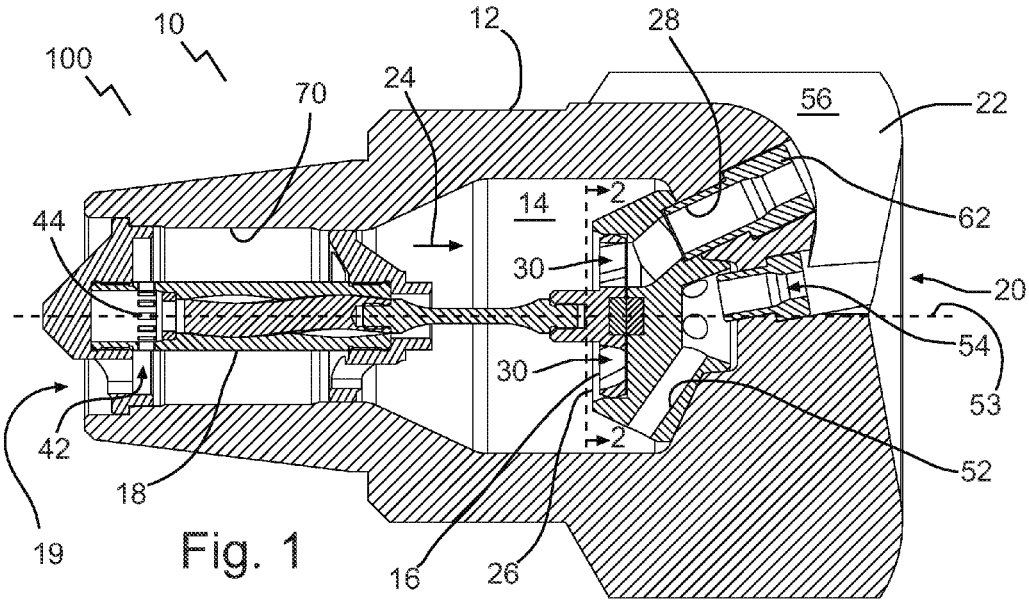
FIG. 1 is a side elevation view, in section, of a drill bit.
Figure 8A:
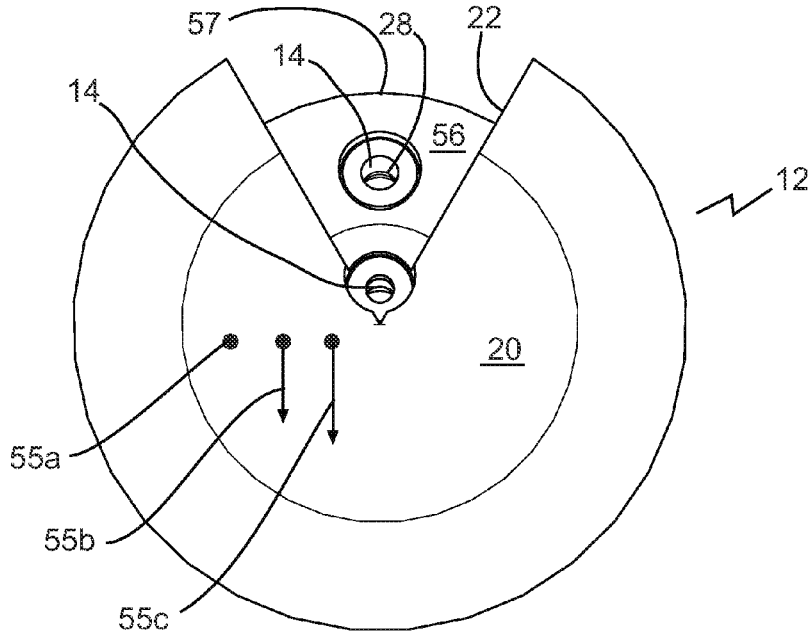
FIG. 8A is an end view of an embodiment of the cutting face of a drill bit with an indented blade.
Figure 8B:
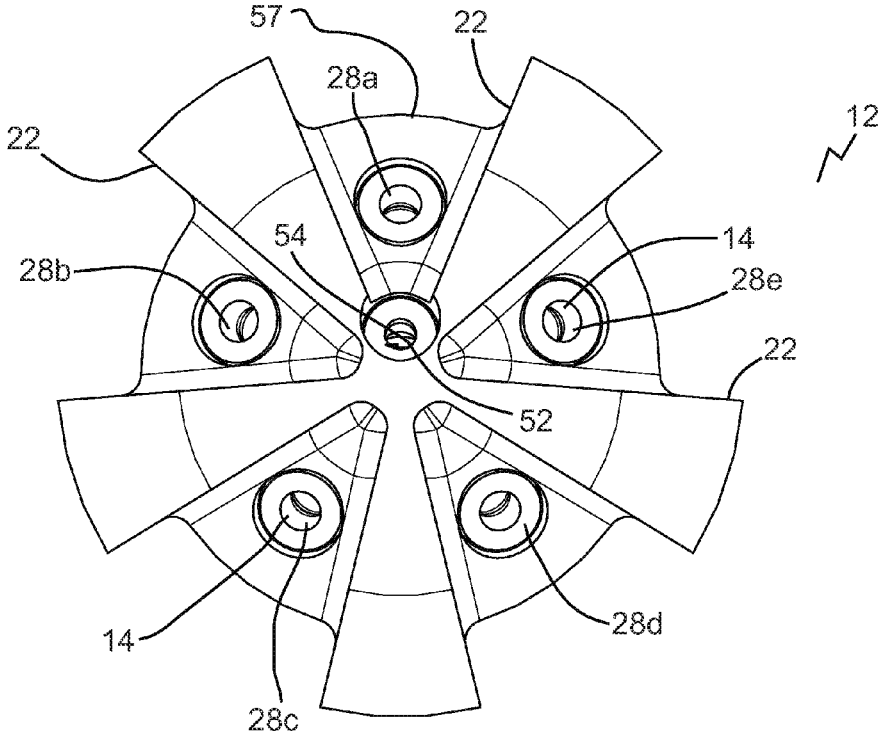
FIG. 8B is an end view of another embodiment of the cutting face of a drill bit with a plurality of cutting elements.

Referring to FIG. 1, a drill bit 10 is illustrated comprising a drill bit head 12, a flow passage 14, a flow interrupter 16, and a power section 18. Referring to FIGS. 1, 8A, and 8B, drill bit head 12 has a cutting face 20 with one or more fixed cutting elements 22. Flow passage 14, which may include one or more flow passages, extends through the drill bit head 12 to the cutting face 20. Referring to FIG. 1, flow interrupter 16 is within the drill bit head 12 and positioned to interrupt flow of fluid (indicated generally by arrow 24) through the flow passage 14. Interrupter 16 may include a valve. Power section 18, which may be positioned within drill bit head 12, is connected to drive the flow interrupter 16 and cause, in operation, variable flow, for example intermittent flow, of fluid through the flow passage 14.

Figure 2:
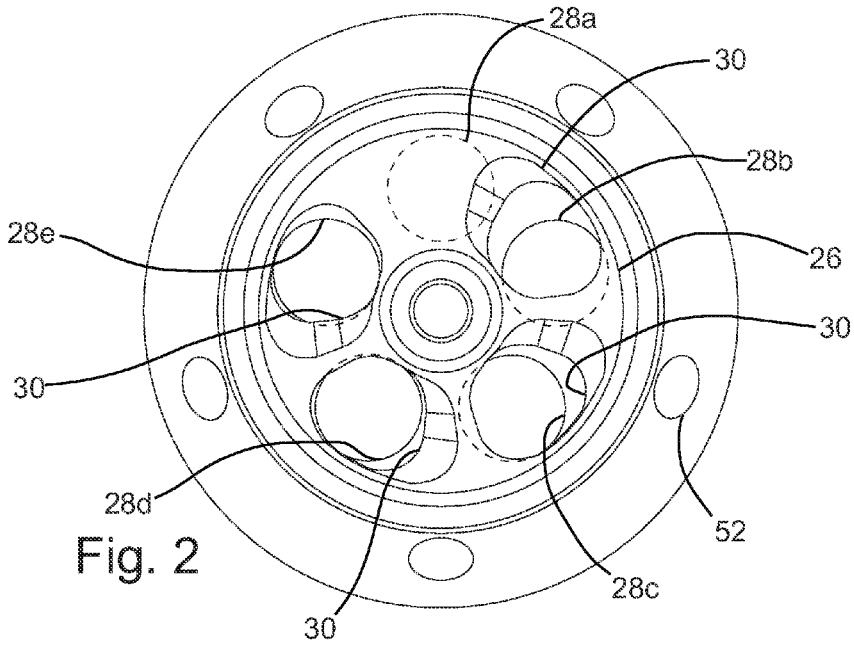
FIG. 2 is an end elevation view, along the section lines 2-2 of FIG. 1.

Referring to FIG. 1, in some embodiments the flow interrupter 16 comprises a disk 26, which may have many forms such as a plate or cam disk, mounted for rotation within the drill bit head 12 for causing, in operation, variable flow of fluid to a channel 28, between the flow interrupter 16 and the cutting face 20, of the flow passage 14. Referring to FIGS. 1 and 2, the disk 26 may have one or more openings 30 through the disk 26 to cause, in operation, variable flow of fluid to the channel 28. Openings 30 in disk 26 may be radially spaced from a center of the disk 26 and extend axially through the disk 26 as shown. Openings 30 may have various angular lengths. More than one disk 26 may be used.

Figure 3:
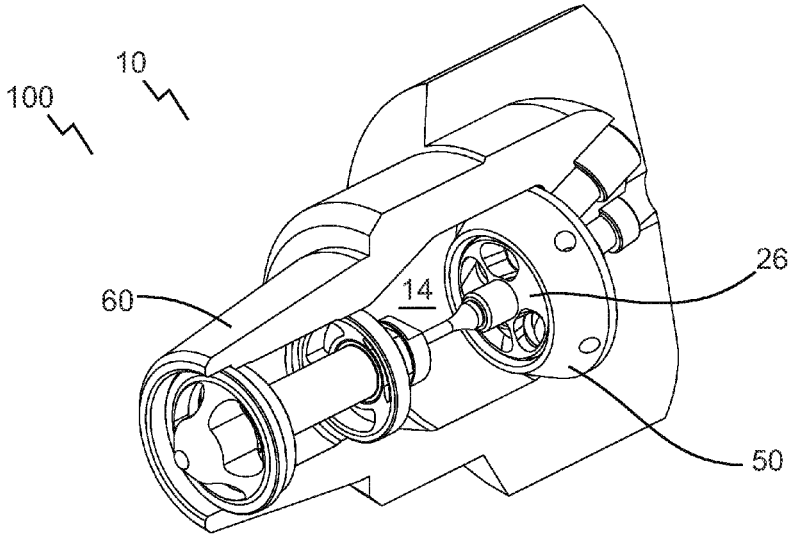
FIG. 3 is a partial cut-away perspective view of the drill bit of FIG. 1.
Figure 4:
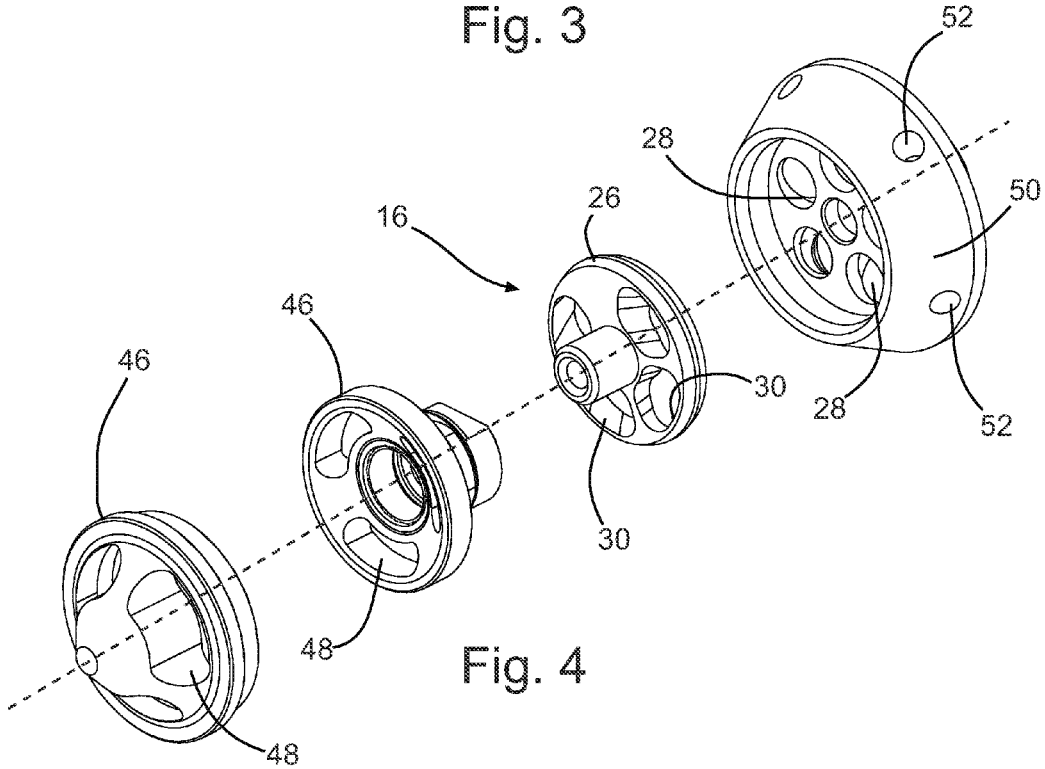
FIG. 4 is an exploded perspective view of internal flow devices within the flow passage of the drill bit of FIG. 1.

Referring to FIGS. 3 and 4, the flow passage 14 is defined internally by drill bit head 12, and any of various components within head 12. Referring to FIG. 4 bit 10 may have one or more power section alignment disks 46, which may be rotationally fixed, that define flow passage 14 through apertures 48. Further, referring to FIGS. 3 and 4, disk 26 of flow interrupter 16 may be mounted within a manifold 50, which may be fixed. Referring to FIG. 4, manifold 50 may define channel 28 as shown. Referring to FIGS. 1 and 4, in some embodiments, flow passage 14 comprises a flow interrupter bypass 52 that allows fluid to at least partially bypass the flow interrupter 16. Referring to FIGS. 1 and 8B, the bypass 52 may be used to provide relatively constant fluid flow out of head 12 from one or more nozzles 54 at the terminus of passage 14 in head 12. The nozzle 54 may be centralized, for further example as shown in order to prevent the creation of a net lateral force on head 12 solely from nozzle 54.

Referring to FIG. 1, the driving of flow interrupter 16 is intended to modify the flow of fluid that travels through each channel 28. In addition, interrupter 16 controls the flow to each channel 28. By varying the flow out of a channel 28, a cyclical net axial force is created that induces head 12 to vibrate during use. This axial force adds a hammering effect to the drilling action of bit 10. In use the frequency of vibration can be tailored to a frequency that most effectively cuts through the type of material that the bit 10 is currently cutting through. The optimal working frequency of vibration depends on the composition of the material being drilled, and may be determined for each type of material in use. To maximize the range of materials that the frequency can be matched with, the bit 10 may be adapted to have a wide range of inducible vibration frequencies, the exact frequency of which can be adjusted in use by increasing or decreasing the flow of fluid to the power section 18. Vibration induction, specifically in the axial direction, is advantageous, because it can improve bottom hole cleaning, cutter cleaning, and bit cutting action under the drill bit 10 between the rock and the drill bit cutters. An overall system (bit/disks/power section) vibration frequency can be generated in this manner in the drill string that improves the actual drill bit rock cutting action, and reduces the overall drill string coefficient of friction between the drill string and the formation or drill cuttings bed. The reduction in coefficient of friction ensures that weight on bit (WOB) is more easily transferred to the drill bit specifically in directional drilling applications.

Referring to FIG. 1, in one embodiment, the flow interrupter 16 is adapted to produce cyclical asymmetric flow out of head 12. This may be accomplished by arranging nozzle(s) 62 about the longitudinal axis 53 of head 12 at offset angles. The angular orientation of each nozzle 62 and varying flow through each nozzle 62 causes a varying lateral force on the head 12, the maximum magnitude of which depends on the flow magnitude and the magnitude of the angular offset of the nozzles 62. Referring to FIGS. 8A and 8B, two different channel 28 arrangements are illustrated that can create this effect. Referring to FIG. 8A, if flow through channel 28 is for example cycled between zero, medium, and full flow, then a changing net lateral force with respective relative magnitudes 55A, B, and C will be imposed on head 12 that causes head 12 to vibrate laterally.

Referring to FIGS. 2 and 8B, an exemplary arrangement of five of channels 28 and four of openings 30 are illustrated. Referring to FIG. 2, at the angular position of disk 26 illustrated, flow through channel 28A is zero, while flow through channels 28B-E are nonzero. As the disk 26 rotates a full rotation, each channel 28 has a minimum flow, in this case zero flow, through it only once. In other embodiments, the minimum flow may occur more than once during a rotation of disk 26. In the example illustrated in FIG. 1, the disk 26 will completely close one channel 28 for every 6.5 degrees of rotation. Referring to FIG. 8B, in the embodiment shown, the flow minimum cycles around each channel 28 once as disk 26 rotates one turn. As each channel 28 closes, a back pressure pulse is created that causes the head 12 to vibrate.

Figure 9:
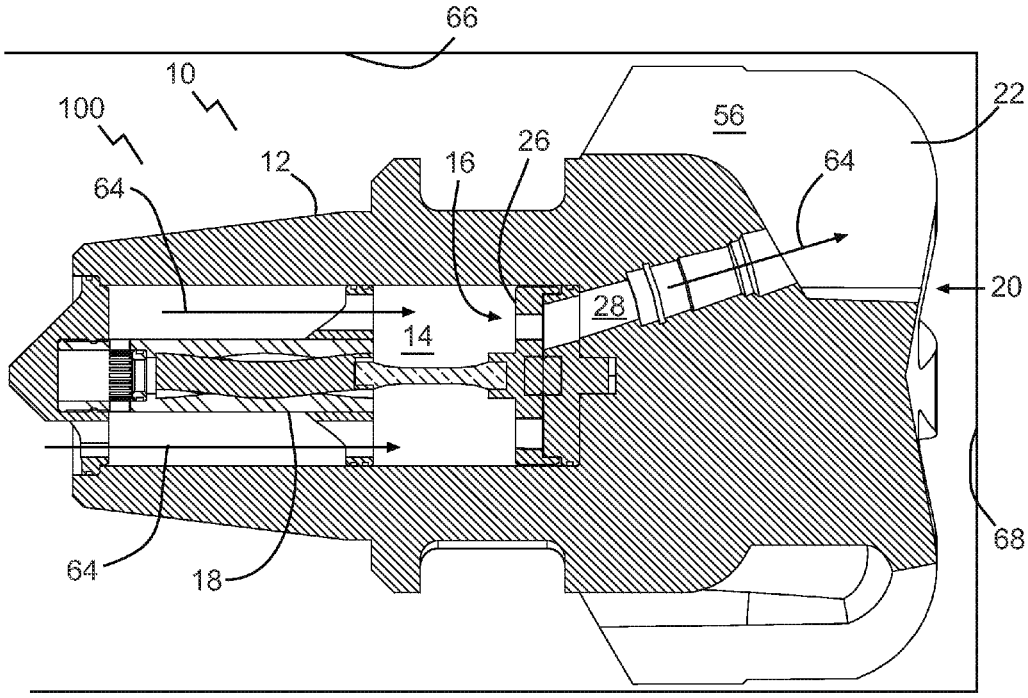
FIG. 9 is a side elevation view, in section, of another embodiment of a drill bit with blades, the drill bit positioned downhole.
Figure 10:
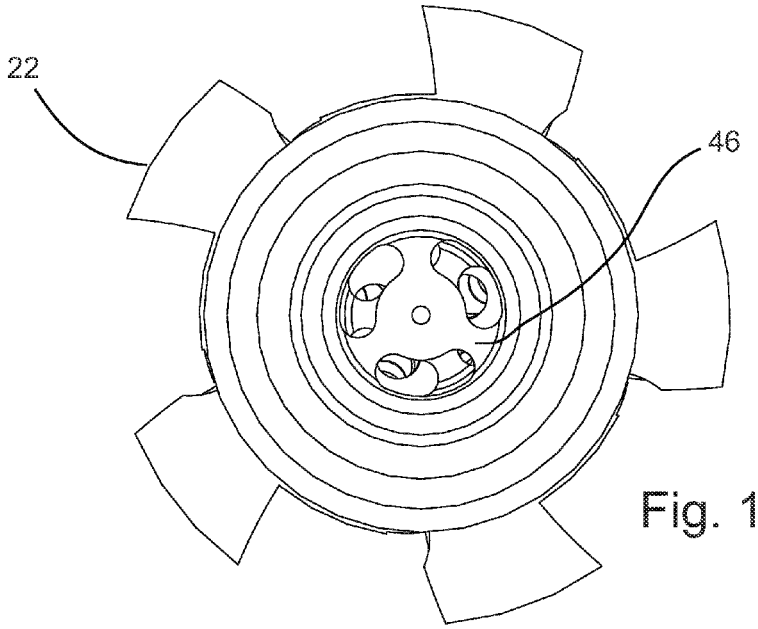
FIG. 10 is an end elevation view of a fluid input end of the drill bit of FIG. 9.

Referring to FIG. 2, the disk 26 may comprise a different number, such as a smaller number, of the one or more openings 30, than a number of channels 28. In some embodiments, the flow interrupter 16 is designed such that a net flow from head 12 cannot be completely cut off while fluid is flowing, to prevent jamming of the bit. Referring to FIG. 9, an embodiment is illustrated where fluid must pass through flow interrupter 16, since there is no flow interrupter bypass 52. In order to prevent flow from being completely cut off in this embodiment, more than one channel 28 may be provided, or disk 26 modified to prevent full cutoff of each channel 28, for further example if only one channel 28 is present.

Figure 6:
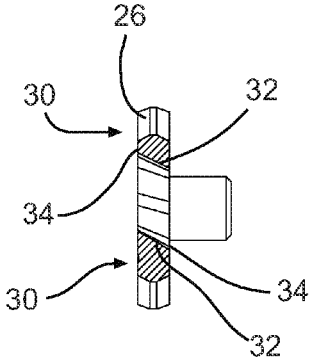
FIG. 6 is a side elevation view, in section, of a disk of a flow interrupter of the drill bit of FIG. 1.
Figure 7:
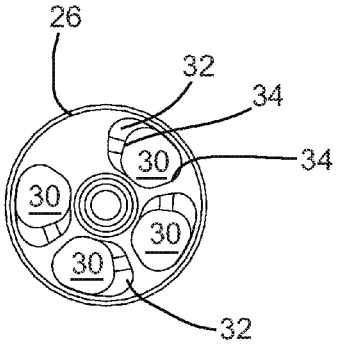
FIG. 7 is an end view of the disk of FIG. 6.

Referring to FIGS. 6 and 7, in some embodiments one or more of openings 30 defines an angled bore surface 32, for example a slanted surface. In these and other embodiments, one or more of openings 30 define a cutting edge 34. Cutting edge 34 may be defined by structure of a suitable part of openings 30, useful for breaking up debris present in the fluids flowing through disk 26. This allows disk 26 to act much like a garburetor by mulching, pulverizing, and/or macerating debris, which improves the function of the bit by preventing large debris from jamming in any of channels 28.

Figure 5:
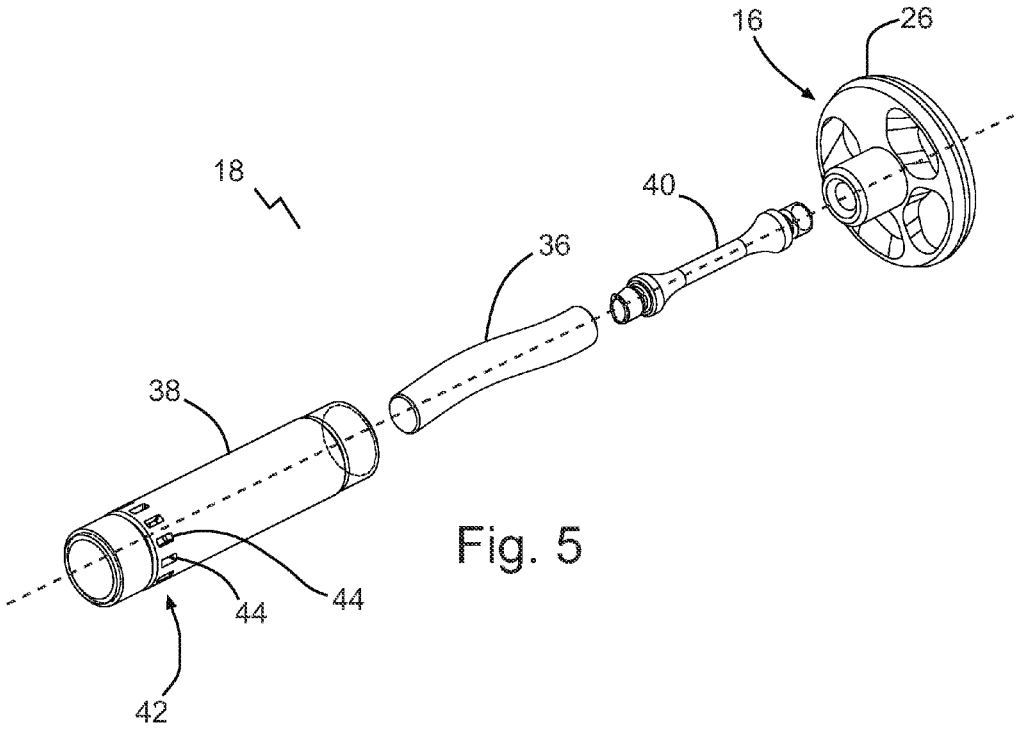
FIG. 5 is an exploded perspective view of a power section and flow interrupter assembly from the drill bit of FIG. 1.

Referring to FIG. 1, the power section 18 may comprise a motor such as a progressive cavity pump. Referring to FIG. 5, an example of such a power section 18 is illustrated with a rotor 36 and stator 38, coupled through a rod 40, to drive the flow interrupter 16. In some embodiments, the power section 18 is a drilling fluid driven power section. In some embodiments the power section 18 has a fluid inlet 42 that comprises a filter. The filter may be a series of slots 44 as shown, for filtering debris from fluid entering the power section 18. Any suitable power section may be used, for example a positive displacement pump or turbine.

The drive rate of flow interrupter 16 may be modified in various ways. For example, as illustrated the fluid inlet 42 for power section 18 may be designed to receive less than the entire flux of fluid flowing through the flow passage 14. By varying the fluid inlet in this way, the ratio of fluid flux through the power section 18 and the entire flow passage may be modified to tailor the drive speed of the flow interrupter. In addition, various power section 18 dimensions, for example rotor/stator size, may be modified to further tailor the drive speed. Moreover, the drive rate can be modified by virtue of being a function of the flow area of openings in the disk 26, the pump pressure of fluid, the composition of fluid, the flow areas of each channel 28, the flow areas at various points along the flow passage 14, for example the flow area defined by the apertures 48 of power section alignment disks 46. Modification of the drive rate provides further control of the vibration frequency induced on the drill bit head 12.

Referring to FIG. 1, having the flow passage 14 extend to the cutting face 20 is advantageous because it aids in removing, or preventing the build up of, debris on cutting face 20. Varying the flow through channel 28 achieves this function more effectively, by pulsing, vibrating, action. In some embodiments, at least one channel 28 of flow passage 14 outputs to a slot 56 between cutting blades. The slot 56 may act as a shunt for fluid to clear from between the cutting blades. Referring to FIGS. 8A and 9, slot 56 may include a reduced outer diameter section 57 relative to the cutting elements as shown. Positioning channel 28 to output onto slot 56 allows fluid from channel 28 to dislodge or agitate debris on face 20 and flush the debris and fluid across slot 56 and up the drill string. Referring to FIG. 1, as illustrated nozzle 62 may be angled to output fluid at least partially across slot 56 in order to direct upon a larger surface area of cutting face 20 for better cleaning action.

Referring to FIG. 3, in some embodiments a dill bit may be retrofitted with the necessary components to provide drill bit 10 as disclosed herein. Referring to FIG. 1, in some embodiments, the flow interrupter 16 and power section 18 are provided as an insert 19 adapted to be inserted into the drill bit head 12. The insert 19 may be provided as one or more assemblies of components, for example the components listed in FIGS. 4 and 5, or a selection of components that can be individually added or removed. This way, insert 19 forms a removable flow interruption system, and drill bit 10 can be operated with or without the flow interruption system as desired. Also, in the event of failure of one or more of the components of the insert, the failed component(s) can be easily replaced. Other components may form part of insert 19 as is suitable.

Modification and/or machining of the drill bit head 12 may be required to ensure a proper fit. Bit 10 is designed as an insert for the bottom of a drill string, by connection for example with threads (not shown) on a thread surface 60 to a drill collar (not shown). Bit 10 may be rotated in use according to known procedures, for example by one of rotation by a downhole motor such as a mud motor, or rotation of the entire drill string. Bit 10 may be used with other drilling methods, such as hammer drilling and jet drilling.

Figure 11:
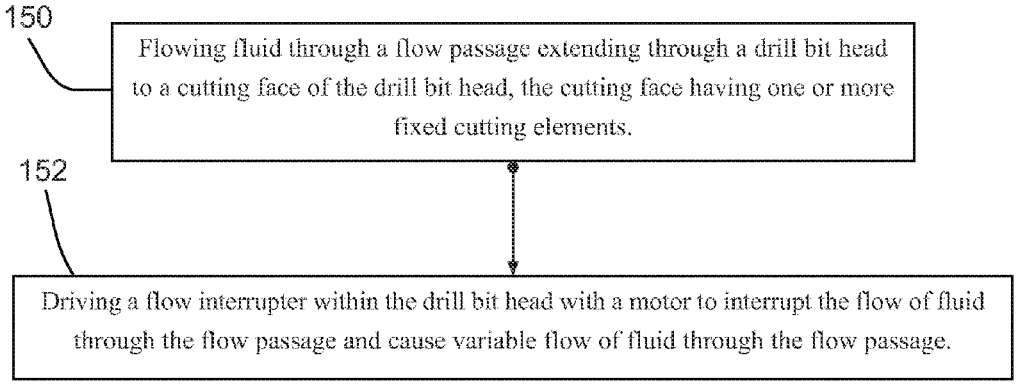
FIG. 11 is a flow diagram of a method of drilling.

Referring to FIG. 11, a method of drilling is illustrated. Referring to FIG. 9, in a stage 150 (shown in FIG. 11) fluid is flowed along lines 64 through a flow passage 14 extending through a drill bit head 12 to a cutting face 20 of the drill bit head 12, the cutting face 20 having one or more fixed cutting elements 22. In a stage 152 (shown in FIG. 11), a flow interrupter 16 is driven within the drill bit head 12 with a power section 18 to interrupt the flow of fluid through the flow passage 14 and cause variable flow of fluid through the flow passage 14. The drill bit head 12 may be located downhole, for example in drilled bore 66 with cutting face 20 facing downhole end 68 of drilled bore 66.

Referring to FIG. 1, an embodiment of a dill bit 100 is illustrated, with a cutting face 20 and a flow passage 14 that extends through drill bit head 12 to one or more downhole facing nozzles 62 and 54 as shown. Downhole facing in relation to a nozzle means the flow direction of output from the nozzle is predominantly downhole, that is, less than 45 degrees from the downhole or axial direction. Cutting face 20 may comprise one or more cutting elements, for example fixed cutting element 22. In these embodiments flow passage 14 may not extend to the cutting face 20, for example if bit 10 is a roller bit. Suitable cutting elements include fixed cutting elements 22 such as blades or PDC cutters if the bit 10 is a drag bit, or cones if a roller bit is used such as a single, dual, or tri-cone bit. PDC cutters may be arranged along a blade of the cutting face 20 of a drag bit.

In some embodiments of bit 100, a disk 26 is mounted for rotation within the drill bit head 12, the disk having one or more openings 30 through the disk 26. A power section 18 is connected to rotate the disk 26 and cause, in operation, variable flow of fluid through the one or more openings 30 to a channel 28, between the disk 26 and the downhole facing nozzle, of the flow passage 14.

Referring to FIG. 1, in some embodiments of drill bit 100 a flow interrupter 16 is within the drill bit head 12 and positioned to interrupt flow of fluid through the flow passage 14, and a progressive cavity pump (indicated by power section 18) is connected to drive the flow interrupter 16 and cause, in operation, variable flow of fluid through the flow passage 14. A progressive cavity pump is advantageous for this operation, because it is a rugged pump suitable for pumping slurries of fluid such as those used for drilling fluid.

Referring to FIG. 1, in some embodiments of drill bit 100 a flow interrupter 16 is within the drill bit head 12 and positioned to interrupt flow of fluid through the flow passage 14. The flow passage 15 comprises a flow interrupter bypass 52 that allows fluid to bypass the flow interrupter 16. A power section 18 is also connected to drive the flow interrupter 16 and cause, in operation, variable flow of fluid through the flow passage 14. The cutting face 20 may comprise one or multiple rolling cones (not shown) in this embodiment.

Various components of bit 10 may be defined by one or more other components. Other suitable components not recited may make up part of the structure of bit 10. Any of the components and characteristics of one of bit 10 and 100 can be readily incorporated into the other. Referring to FIG. 1, nozzles 62, for example jet nozzles, may be provided as downhole facing nozzles of channels 28. It should be understood that various of the embodiments disclosed herein may be used in any of the other embodiments disclosed herein. Further, all embodiments of the drill bits disclosed herein may be used in a similar fashion as that disclosed herein.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A drill bit, comprising:

a cutting face with one or more fixed cutting elements;

a flow passage extending through a drill bit head to the cutting face;

a flow interrupter within the drill bit and positioned to interrupt flow of fluid through the flow passage, the flow interrupter comprising: a disk having at least one opening and a manifold, wherein the disk is rotationally mounted in the manifold such that the at least one opening is rotated in and out of alignment with the flow passage to interrupt fluid flow during operation; and a power section within the drill bit having a housing defining a first flow path internal to the housing and a second flow path external to the housing, the power section comprising a short stage positive displacement motor internal to the housing wherein the short stage positive displacement motor rotates when fluid flows along the first flow path, the power section comprising a shaft coupled to the disk to cause the disk to rotate in the manifold.

2. The drill bit of claim 1 in which the disk has a plurality of openings through the disk to cause, in operation, variable flow of fluid to the channel.

3. The drill bit of claim 2 in which at least one of the plurality of openings defines an angled bore surface.

4. The drill bit of claim 2 in which at least one of the plurality of openings defines a cutting edge.

5. The drill bit of claim 1 in which the power section comprises a progressive cavity pump.

6. The drill bit of claim 1 in which the power section is a drilling fluid driven power section.

7. The drill bit of claim 6 in which the power section has a fluid inlet that comprises a filter.

8. The drill bit of claim 1 in which the manifold comprises a bypass that allows fluid to bypass the flow interrupter.

9. An insert adapted to fit into a flow passage of a drill bit, the insert comprising:

a first alignment disk, the first alignment disk having a first plurality of apertures adapted to allow fluid to flow through the first alignment disk;

a short stage positive displacement motor having a first end and a second end opposite the first end wherein the first end of the short stage positive displacement motor is coupled to a downstream side of the first alignment disk;

a second alignment disk, the second alignment disk having a second plurality of apertures adapted to allow fluid to flow through the second alignment disk, the short stage positive displacement motor coupled to an upstream side of the second alignment disk;

a rod having an upstream end and a downstream end opposite the upstream end, the upstream end of the rod coupled to the second end of the short stage positive displacement motor;

a flow interrupting disk coupled to the downstream side of the rod, the flow interrupting disk having at least one opening; and a manifold defining an interior space having at least one channel, wherein the flow interrupting disk is rotationally contained within the interior space of the manifold such that during operation the at least one opening is rotated in and out of alignment with the at least one channel.

10. The insert of claim 9 wherein the short stage positive displacement motor comprises a rotor and a stator wherein the rotor is rotationally coupled to the stator and the stator is fixedly coupled to the first and second alignment disks.

11. The insert of claim 10 wherein the rotor is operatively coupled to the rod.

12. The insert of claim 10 wherein the stator comprises a plurality of slots adapted to allow fluid to flow in a space formed between the stator and the rotor.

13. The insert of claim 12 wherein the plurality of slots are configured to filter the fluid.

14. The insert of claim 9 wherein the first plurality of apertures substantially align with the second plurality of apertures.

15. The insert of claim 9 wherein the flow interrupting disk comprises a plurality of openings.

16. The insert of claim 15 wherein at least one of the plurality of openings defines an angled bore surface.

17. The insert of claim 15 wherein at least one of the plurality of openings defines a cutting edge.

18. The insert of claim 9 wherein the short stage positive displacement motor is a progressive cavity motor.

19. The insert of claim 9 wherein the short stage positive displacement motor is between 1 to 3 stages.

* * * * *